US005740733A

United States Patent [19]

Mungenast

[11] Patent Number: 5,740,733

[45] Date of Patent: Apr. 21, 1998

[54] METHOD FOR PRODUCING A HALF-TONE STENCIL INCLUDING REFERENCE STRUCTURES FOR ASSESSING ACCURACY OF PRINTING WITH THE STENCIL

[75] Inventor: Heinz Mungenast, Kufstein, Austria

[73] Assignee: Schablonentechnik Kufstein Aktiengesellschaft, Kufstein, Austria

[21] Appl. No.: 833,531

[22] Filed: Apr. 7, 1997

[30] Foreign Application Priority Data

Apr. 19, 1996 [EP] European Pat. Off. ..... 96106203

[51] Int. Cl.[6] ..... B41C 1/14

[52] U.S. Cl. ..... 101/128.4; 101/116; 101/129

[58] Field of Search ..... 101/114, 116, 101/127, 128.21, 128.4, 129

[56] References Cited

FOREIGN PATENT DOCUMENTS

| | | | |
|---|---|---|---|
| 0-679510 | 4/1994 | European Pat. Off. . | |
| 2107738 | 6/1972 | Germany | 101/128.4 |
| 2229722 | 12/1972 | Germany | 101/127 |
| 1588967 | 7/1978 | Germany | 101/128.21 |
| 1912596 | 4/1981 | Germany | 101/128.4 |
| 83167 | 5/1984 | Japan | 101/129 |
| 178393 | 8/1987 | Japan | 101/128.4 |
| 7614404 | 6/1977 | Netherlands | 101/129 |

*Primary Examiner*—Stephen R. Funk

[57] ABSTRACT

During the production of a half-tone stencil, a stencil pattern hole structure is engraved in a predetermined stencil pattern area of a basic stencil element in order to form a stencil pattern. A plurality of uniform reference hole structures having different degrees of permeability are formed on the basic stencil element outside the stencil pattern area. These reference hole structures are used during the subsequent printing for producing printing patterns used for assessing the quality of color fidelity of a stencil pattern print.

16 Claims, 4 Drawing Sheets

METHOD FOR PRODUCING A HALF-TONE STENCIL INCLUDING REFERENCE STRUCTURES FOR ASSESSING ACCURACY OF PRINTING WITH THE STENCIL

FIELD OF THE INVENTION

The invention relates to a method for producing a half-tone stencil by engraving a reference pattern in a predetermined area.

BACKGROUND OF THE INVENTION

Stencils for textile printing which, for example, and according to the pattern to be produced, apply different amounts of ink per unit area (half-tone printing) are generally known.

However, in half-tone printing there is the difficulty that many settings of operating parameters, both on the engraving device used for producing the stencil and on the printing machine, are left to the judgement and the skill of the engraver or of the printer as a result, precisely in the area of half-tone printing, unintentional, severe deviations from the intensity profile of the half-tone print which is aimed at are produced. Thus, for example, as a result of halftone stencils which have not been engraved with the nominally correct opening relationships, or as the result of an unintentionally wrongly set printing machine or of one of the printing stations, some of the inks are applied with the wrong intensity. In the case of polychromatic prints, in particular, this immediately leads to an appreciable disturbance of the color reproduction, which means nothing more than that those colors whose correct reproduction is based on the maintenance of precise quantity ratios of the individual components will be completely wrongly reproduced in terms of color.

SUMMARY OF THE INVENTION

The invention is based on the object of providing half-tone stencils or, respectively, of specifying a method for their production, with which a half-tone print may be carried out more accurately or more true to color. Furthermore, it is the aim of the invention to provide a device which is suitable for the production of such half-tone stencils.

A method according to the invention is distinguished by the fact that a plurality of uniform reference hole structures, which each have different degrees of permeability and lie outside the stencil pattern area, are engraved into the basic stencil element.

The reference hole structures can also be called half-tone marks or area marks. These reference hole structures or area marks can lie directly adjacent to one another but can also be spaced apart from one another or separated.

According to the invention, at the end of the half-tone stencil, in addition to any printing marks (pico) which are already present, the reference hole structures are produced, with which specific prescribed color intensities are intended to be achieved when the stencil is used for printing. These reference hole structures comprise small areas, for example squares, rectangles or circles, which are engraved with different but predetermined degrees of permeability and, given the nominally correct degree of permeability and, given the correct setting of all the parameters on the printing machine during the later printing with such a half-tone stencil, yield a defined and therefore checkable sequence of color intensity values from the intensity range from 0 to 100%.

By checking the intensity values of the printed images which are obtained with the aid of the reference hole structures, and if appropriate by changing the printing parameters as a function of the result of the check, it is thus possible to achieve an improved halftone printing, even in the stencil pattern area, since the stencil pattern hole structure which is present there is related to the reference hole structure (it is not necessary for the two to be identical).

According to an advantageous development of the invention, the degree of permeability of each reference hole structure is compared with a respective desired degree of permeability, in order to engrave the uniform reference hole structures anew, as a function of the respective deviation, in such a way that the said deviation decreases, this sequence of steps being executed at least once.

The advantage of this measure is to be seen in the fact that, even before the actual printing, the "degree of permeability" parameter can be brought to its desired value (or at least approximated to this), so that later, during the actual printing, the remaining printing parameters no longer need to be altered to such a great extent, which under certain circumstances would possibly even no longer be possible at all, in order to reach the desired color intensities for the respectively prescribed degrees of permeability (desired degrees of permeability). The desired degree of permeability is to be understood here as the nominally correct opening ratio of the half-tone stencil. The actual degree of permeability is then related to the opening ratio actually achieved of the half-tone stencil.

According to a further advantageous development of the invention, the stencil pattern hole structure lying in the stencil pattern area is engraved as a function of the deviations. Therefore, in the event of a deviation of the actual degree of permeability from the desired degree of permeability, not only is a re-engraving of the respective reference hole structure carried out, but rather a change to the engraving parameters is also undertaken in order to come to an improved stencil pattern hole structure. As already mentioned, the degrees of permeability in various areas of the stencil pattern hole structure do not necessarily have to be identical with the degrees of permeability of the reference hole structures. Rather, the former are related to the latter, so that in the event of a change to the degree of permeability of the reference hole structure as the result of a deviation from the corresponding desired degree of permeability, the relationship is likewise to be changed appropriately.

According to a refinement of the invention, the respective old reference hole structures are removed after their degree of permeability has been compared with the desired degree of permeability. In this case, the removal of the old reference hole structures can be carried out before new engraving. The removal is possible, for example as a result of the fact that the old reference hole structures are simply cut out from the basic stencil element. However, it is more advantageous to varnish over them and in each case to engrave new reference hole structures in the corresponding areas.

According to a very advantageous further refinement of the invention, the degree of permeability of a respective reference hole structure is measured automatically. It is in principle possible for the comparison between the degree of permeability and the desired degree of permeability of a respective reference hole structure to be carried out visually, that is to say by the engraver. However, automated monitoring is more expedient, since it can be carried out more rapidly and more accurately. Furthermore, for the visual comparison it is necessary for the reference hole structures to be relatively extensive, that is to say for the rectangles, squares or circles already mentioned at the beginning by way of example to be relatively large. The respective reference hole structure then comprises very many stencil openings. However, if the degree of permeability is measured automatically, this can already be carried out while using relatively few stencil openings or smaller reference hole structures, which saves time and space on the basic stencil element.

It is possible, for example, to use as basic stencil element a screen on which a covering layer is applied which leaves screen openings free, at least in some areas, to form a reference hole structure.

The covering layer can be a lacquer layer covering the screen, which is burnt away in some areas with the aid of a laser beam in order to expose the screen openings. It may also have polymerizable properties, in order to be cured by point-by-point illumination by means of a laser beam, for example. In a following development process, the unexposed areas of the lacquer layer are then removed, in order to expose the screen openings. However, the covering layer can also, if it has polymerizable properties, be covered point-by-point with the aid of liquid which is opaque. Large-area illumination and curing of the non-covered layer areas are then carried out, and subsequently a development process to remove the non-cured layer areas. Alternatively, the lacquer layer can also be produced by spraying a liquid covering material onto the screen by means of a nozzle. The nozzle is switched off wherever stencil openings are intended to be produced.

Furthermore, it is possible to use, as basic stencil element, one having a closed surface, on which a covering layer is applied which leaves the surfaces free, in some areas, to form the reference hole structure.

Here too, the covering layer can be produced by burning away by means of a laser beam, by point-by-point illumination and subsequent development (if it is polymerizable) or by the liquid being sprayed, with the aid of a nozzle, onto the surface of the basic stencil element. Likewise, it is also possible here for the covering layer to be initially covered point by point with liquid which is opaque. After this, once more illumination over a large area can take place, in order to cure the layer areas not covered by the liquid. There then follows a development process in order to dissolve out the non-cured layer areas.

After the covering layer with the appropriate plurality of reference hole structures has been prepared, these are then measured, in order to determine the degree of permeability of the respective reference hole structures. Finally, if the degree of permeability coincides with the desired degree of permeability, or if the latter is approached sufficiently closely, metallic material is applied on the covering layer in order to obtain a screen which is subsequently removed from the basic stencil element. If this layer consists, for example, of nickel, nickel can be deposited on its surface by electroplating in order to form the screen. The finished screen then contains not only the plurality of reference hole structures but also the finished stencil pattern.

For the case of a screen which is present from the beginning, the permeability of the reference hole structure is measured by means of a beam of light which passes through the screen openings, runs essentially at right angles to the stencil surface and can pass through the latter in one direction or the other. The beam of light is focused, the focus coming to lie in the stencil surface.

As an alternative, in this case the degree of permeability of the reference hole structure can also be measured by means of a stream of gas passing through the screen openings.

For the case of a basic stencil element having a closed surface, the degree of permeability of the reference hole structure in the lacquer layer located on this surface is measured by means of a beam of light reflected at the free surface. Depending on the size of the openings belonging to the reference hole structure, the magnitude of the reflected intensity changes, which is a measure of the size of these openings. However, it must be taken into account here that the screen openings of the screen which is fitted later come to lie where material of the covering layer is still present during the measurement. This must be taken into account during the determination of the degree of permeability.

If it is determined, following the measurement of the degree of permeability, that this deviates from the desired degree of permeability, then, depending on the production variant, preferably the pulse duty factor of the laser beam or an on/off switching cycle of the nozzle which is spraying the liquid is varied, in order to equate the degree of permeability to the desired degree of permeability.

In a development of the invention, the basic stencil element can be constructed as a hollow cylinder, so that half-tone rotary printing stencils can also be produced using the process according to the invention.

A device according to the invention for producing a half-tone stencil contains a bearing device for the rotatable mounting of a hollow cylinder; a device for machining the outer peripheral surface of the hollow cylinder; a carriage which can be displaced parallel to the hollow cylinder axis and carries at least part of the machining device; and a control device for controlling the machining device and for displacing the carriage when the hollow cylinder is rotating. This device is distinguished by the fact that it has a measuring device for measuring the degree of permeability of a reference hole structure lying in a prescribed stencil area.

The reference hole structures are in this case preferably located at only one end of the hollow cylinder, so that the location of the measuring device is selected appropriately. It can therefore be fastened, for example, to the bearing device.

Not least, a half-tone stencil having a stencil pattern area lying approximately centrally is distinguished by the fact that it has, outside the stencil pattern area, a plurality of uniform reference hole structures which each have different degrees of permeability. In this case, the half-tone stencil can be designed to be a hollow cylinder, in order to obtain a rotary printing stencil. The reference hole structures may lie directly adjacent to one another or be arranged separated from one another.

It should be pointed out once more that the term reference hole structure is to be understood as an area in which there is a plurality of uniform or uniformly opened screen openings or a plurality of uniform or identical structures which are used for forming screen openings. In the case of the screen openings, the different degrees of permeability are achieved by these screen openings being covered to a greater or lesser extent by the covering layer. In the case of the structures mentioned for forming the screen openings, different degrees of permeability in the screen to be formed later are achieved by the structures being constructed to be more or less wide.

The present invention will become more fully understood from the detailed description given hereinbelow and the accompanying drawings which are given by way of illustration only, and thus are not limitative of the present invention.

BRIEF DESCRIPTION OF THE DRAWINGS

The drawing shows exemplary embodiments of the invention, as follows.

DETAILED DESCRIPTION OF THE PREFERRED EMBODIMENT

Figure 1:
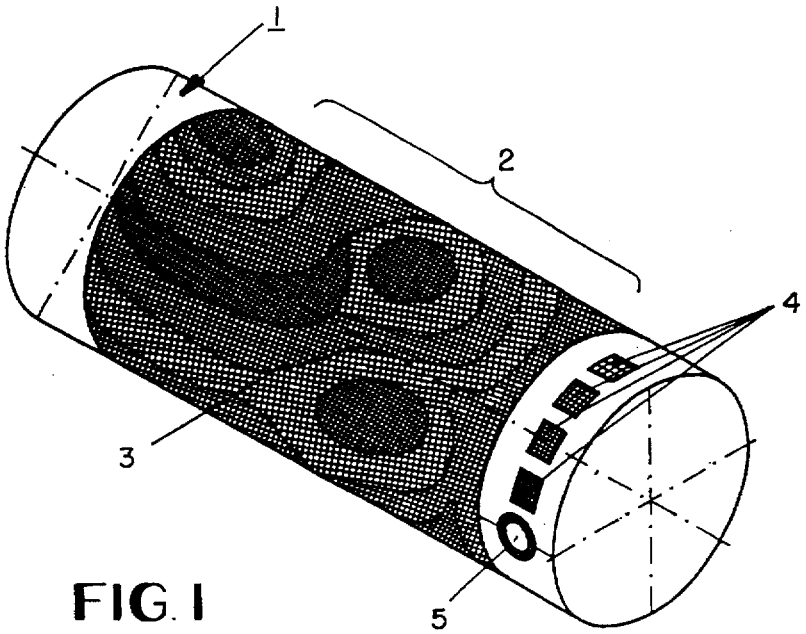
FIG. 1 shows a half-tone rotary printing stencil having a plurality of reference hole structures of a different degree of permeability in each case.

FIG. 1 shows a hollow cylindrical rotary printing stencil 1, produced according to the invention, for half-tone printing, which is equipped in its central part or stencil pattern area 2 with an engraving or stencil pattern hole structure in order to form a stencil pattern 3. The stencil pattern 3 has different permeability relationships in different areas. In the present case, the half-tone stencil 1 comprises a hollow cylindrical screen with a covering layer located on it, in which the stencil pattern hole structure has been engraved, in order to expose screen openings in the cylindrical carrier screen, at least in some areas.

Outside the stencil pattern area 2 there are, for example at an end edge of the half-tone stencil 1, area marks 4 which each have a uniform reference hole structure but differ in terms of the degree of permeability. Shown in FIG. 1 are four area marks 4 which respectively have permeabilities of 10, 50, 75 and 100% and are arranged separately from one another. In this case, the permeabilities depend not only on the extent to which the respective screen openings of the cylinder screen located underneath the covering layer have been exposed, but also on the type and viscosity of the inks which later pass through the stencil openings, on the liquid pressure etc. Moreover, the permeabilities in the area of the area marks 4 do not need to be identical to those which are present in the respective areas of the stencil pattern 3.

In addition, a further printing mark 5 (pico) is provided, which is embodied here by a circular ring. It has the object of being helpful in adjusting a plurality of half-tone stencils in relation to one another in a rotary printing machine.

For the purpose of the visual assessment of the engraving, a comparison standard can be held against the area marks 4 or uniform reference hole structures shown here, said comparison standard likewise consisting of lacquer-coated, engraved pieces of screen, for example pieces of nickel screen. In the case of such a visual comparison, it is of course necessary to stop the engraving system. However, if the measurement of the degree of permeability of a respective reference hole structure or area mark 4 is carried out automatically, the comparison can then be carried out with the engraving system running, that is to say the comparison between degree of permeability and desired degree of permeability for the respective area mark 4.

Figure 2:
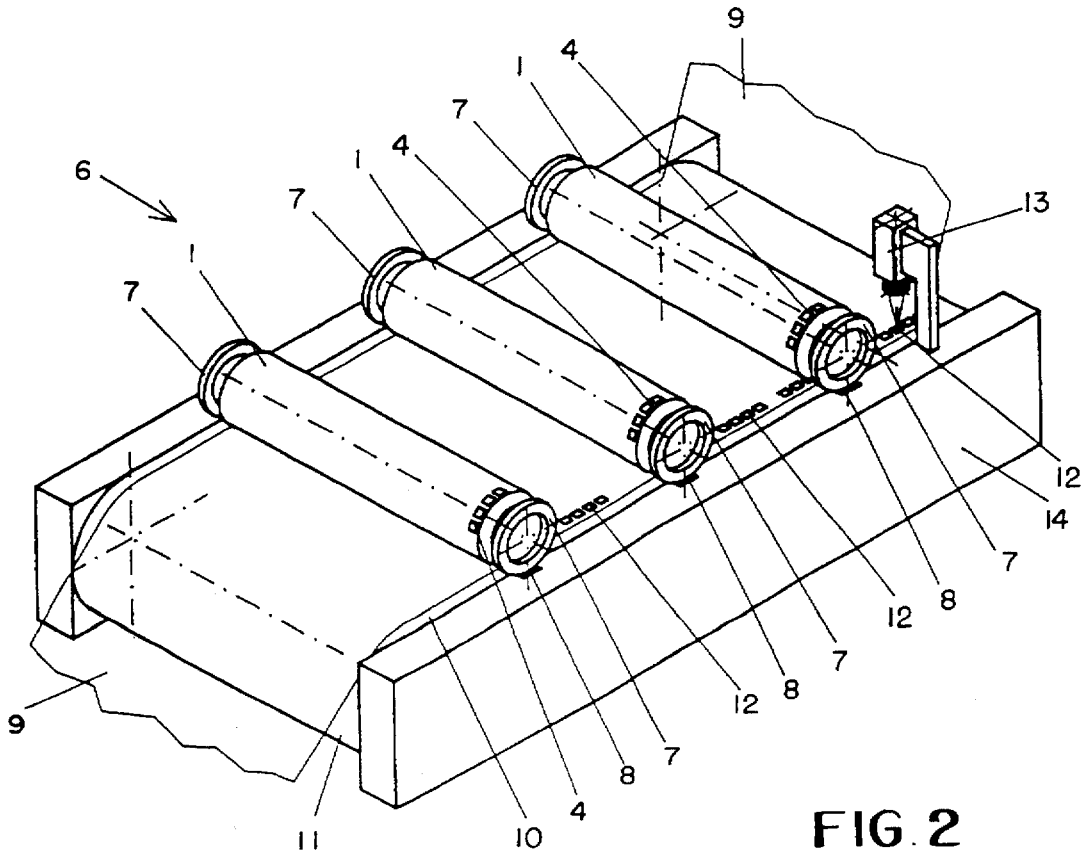
FIG. 2 shows a rotary printing machine in which half-tone rotary printing stencils according to FIG. 1 are used.

Shown in FIG. 2 is a rotary printing machine 6 on which stencils 1 which have been produced in accordance with the invention are used. In such a machine 6, the stencils 1 are driven via gearwheels 7 and repetition gearing 8, so that the stencils run synchronously with the material web 9 which is guided under the stencils 1 and through the machine 6. The gearwheels 7 are fastened to stencil heads which are bonded into the ends of the stencils 1. The material web 9 is bonded onto the under-blanket 10 using a very easily detachable adhesive, and is held firmly by the underblanket 10 during printing. The underblanket 10 is a very broad rubber fabric transport web; it is driven by two deflection rolls 11, around which the underblanket 10 wraps. This arrangement achieves the mentioned synchronous running between stencils 1 and material web 9 to be printed. The area marks 4 of each stencil 1 are printed onto the material web 9 together with the pattern and produce area mark images 12 there. A video camera 13 is mounted at the end of the printing machine 6 on its side wall 14 and continuously measures the color intensities of the area mark images 12. If a deviation of the shade or of the color intensity is established, then either an acoustic or a visual signal is emitted, or the inking unit to be readjusted is acted on by a servo mechanism, if there is one such present.

Figure 3:
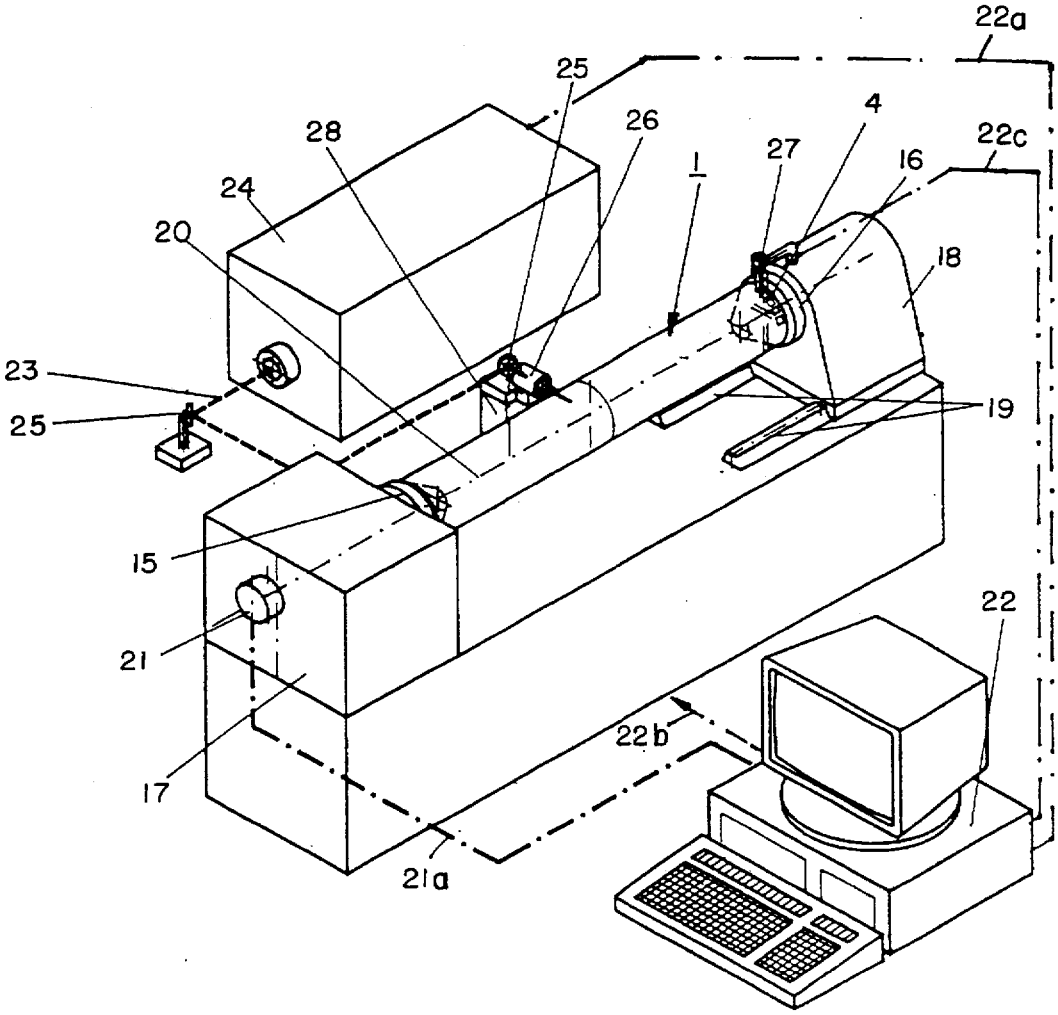
FIG. 3 shows a laser engraving system for producing the half-tone rotary printing stencil shown in FIG. 1.

Shown in FIG. 3 is a laser engraving system. The stencil 1 to be engraved is centered between two clamping cones 15 and 16 and is firmly held. The clamping cone 15 is rotatably driven and is mounted in a gearbox 17, in which the drive motor is also located. The stencil 1 is pushed onto the clamping cone 15 by its left-hand end. The clamping cone 16 is rotatably mounted in a tailstock 18 and is not driven in this exemplary embodiment. The tailstock 18 can be adjusted on guides 19 in the direction of the connecting axis 20 between the two clamping cones 15 and 16, and can thus be set to any desired lengths of the stencil 1. Connected in a torsionally stiff manner to the clamping cone 15 is an encoder 21, which provides the pulse or rotary position signals for the engraving system computer 22 via a line 21*a*. For the purpose of the engraving, a laser beam 23, which is emitted from the laser 24, is focused onto the surface of the stencil 1 via deflection mirrors 25 and an optical system 26. The laser beam 23 is cycled in accordance with the requirements of the pattern 3 via a line 22*a* from the computer 22, that is to say it is switched on or off, and a lacquer layer la is correspondingly removed from the cylinder screen 1*b* or is cured. During the engraving, the stencil 1 rotates at about 500 to 1200 rev/min and, at the same time, a carriage 28, which carries the optical system 26, is advanced in the direction of the connecting axis 20 by means of an advance spindle, which is not visible. The carriage displacement takes place under the control of the computer 22 via a line 22*b*.

At the beginning of the engraving operation, the area marks 4 are engraved first. These are subjected to an inspection directly after their production and still before engraving of the actual pattern 3 is begun. A measuring or inspection device 27 is fastened on the tailstock 18 in the case of this exemplary embodiment. However, it can be entirely expedient to fit this device 27 on the gearbox 17 and then to provide the area marks 4 on the opposite edge of the stencil 1. The inspection device 27 may have one of the types of construction described in the following figures. Its output signals are transmitted via a line 22*c* to the computer 22.

Figure 4:
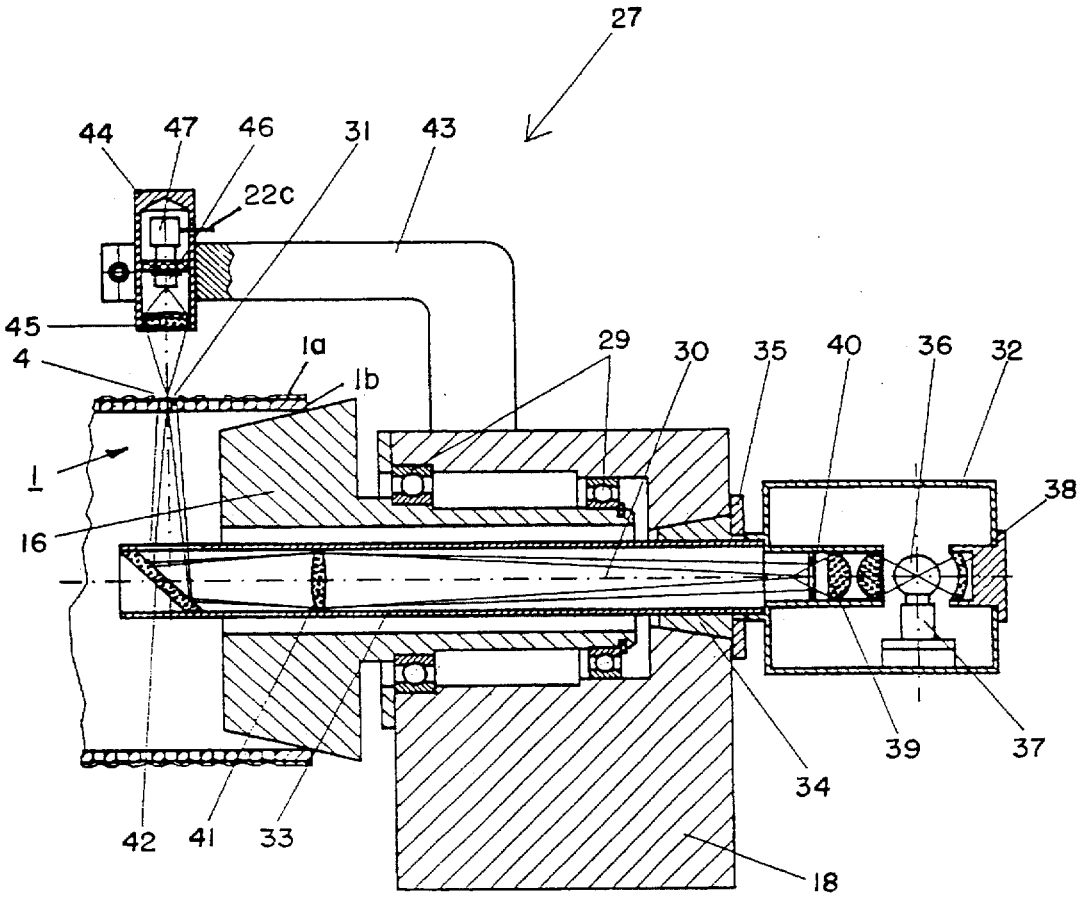
FIG. 4 shows an axial section through the right-hand bearing area of the laser engraving system according to FIG. 3.

Shown in FIG. 4 is an inspection device 27 which uses an optical measuring method for determining the degree of permeability of the engraved area marks 4. The tailstock 18 contains not only the clamping cone 16, which is mounted on ballbearings 29, but also a projection device 30 for producing a virtual image 31. This is located approximately in the area of the cover of the stencil 1. A tube 33 carries a lamp housing 32 beginning from its right-hand end. This tube 33 is held by means of a conical clamping sleeve 34 in a matching conical receiving bore in the tailstock 18. A pressure plate 35 presses the clamping sleeve 34 into this receiving bore. Provided inside the lamp housing 32 is a projection lamp 36, which is held by a mount 37. A hollow mirror 38 is used to increase the light yield from the projection lamp 36. Part of the useless amount of light which is emitted is reflected back by this hollow mirror 38 into the condensor 39. A metallic diaphragm 40 contains a diaphragm opening in circular form or in the form of a square. This diaphragm 40 is illuminated as uniformly as possible by the condensor 39. The diaphragm opening is projected onto the cover of the stencil 1 as a virtual image 31 by means of an optical system 41 (achromat), via a deflection mirror 42. Of this virtual image 31, it is possible to perceive from the outside only those points which fall upon the points of the stencil 31 which have been laid open. A holder 43 on the tailstock 18 carries a semiconductor camera 44, which images the visible parts of the virtual image 31, via a further optical system 45, onto a light-sensitive semiconductor (photodiode, phototransistor, photoresistor) 46. The output signal from this semiconductor 46, which is triggered by the incidence of light, is amplified by an integrated pre-amplifier 47 and is used as a measure of the permeability of the engraving which has been measured in this way.

Figure 5:
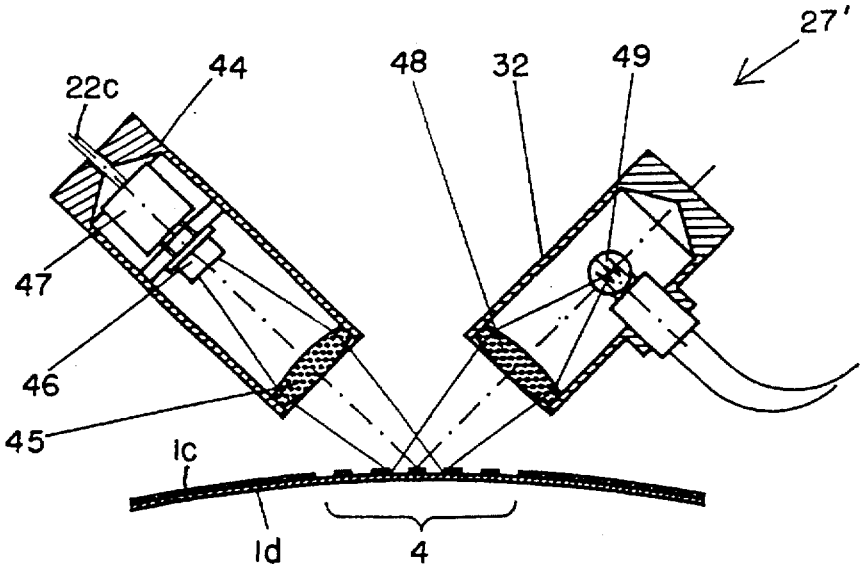
FIG. 5 shows an optical reflection measuring device for measuring the degree of permeability of a reference hole structure on the surface of a stencil blank, on which metallic material is applied by electroplating in order to form a screen-printing stencil.

Shown in FIG. 5 is a further inspection device 27', operating on an optical basis, which uses the radiation reflected from the area of the area mark 4 for measuring the engraving quality. This device 27' is used when the engraving is intended to be made into a layer 1*c* on a closed (that is to say not screen-like) hollow cylinder 1*d*. The illuminating portion of a lamp 49 is imaged onto the surface of the area mark 4 via an optical system 48 of a lamp housing 32. This lamp housing 32 can naturally also be constructed in a somewhat more complicated manner—approximately as was shown in FIG. 4. In any case, the illumination of the area mark 4 is carried out such that as far as possible the whole of the area enclosed by it is illuminated as uniformly as possible. The light reflected by the area mark 4, or rather the intensity of the former, is measured by the semiconductor camera 44 and used for the assessment of the degree of permeability of the area mark 4. An image of the area mark 4 is projected by the optical system 45 onto the light-sensitive semiconductor 46, and its output signal is amplified by the integrated amplifier 47 and forwarded to the evaluation unit 22, which is not further shown.

Figure 6:
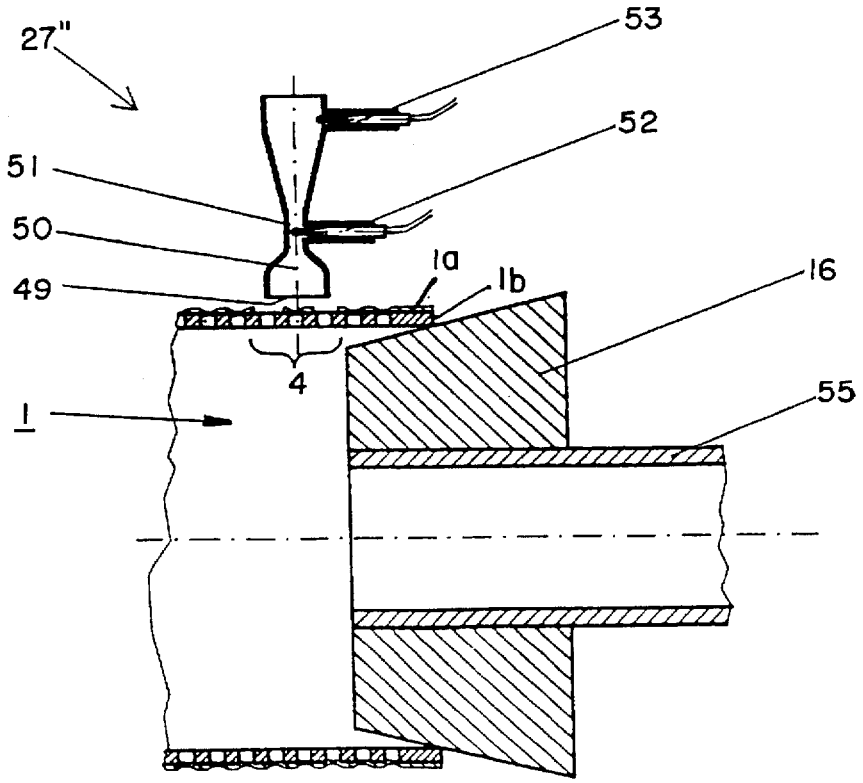
FIG. 6 shows an axial section in the right-hand bearing area of the laser engraving system according to FIG. 3, with a measuring device, operating using a flow technique, for measuring the degree of permeability of a reference hole structure.

FIG. 6 shows an inspection device 27" for determining the engraving quality or the degree of permeability of the area mark 4, which device operates using flow technology and is designed as a measuring nozzle. The interior of the stencil 1 is at a somewhat elevated air pressure in this exemplary embodiment, approximately of the magnitude of 0.1 to 0.3 bar overpressure. This pressure is produced by feeding compressed air through a hollow shaft 55, which carries the clamping cone 16. The source for this compressed air is a radial blower, which is not further shown and may have multiple stages. Although the pressure can only be maintained as long as relatively large pattern areas are not exposed, this compressed air can be provided with a low power consumption as long as the area marks 4 are the only open areas of the stencil 1. The engraving of these area marks 4 must, however, take place at the beginning of the engraving operation anyway, since the result of the measurement of these marks 4 must be available if need be for any necessary correction of the setting parameters of the engraving machine, before beginning the actual pattern engraving. The restriction mentioned therefore represents no obstacle. The air emerging from the exposed areas of the area marks 4 is intercepted by the mouth 49 of the pneumatically operating inspection device 27" The distance of the mouth 49 from the outer cover of the stencil 1 is preferably smaller than ¼ of the mouth's diameter. The air intercepted by the mouth 49 subsequently flows through a taper 51 in the flow channel 50. It is known from fluid mechanics that in the taper the velocity rises and the static pressure falls, if the flow channel 50 has no opening to the outside here. Located in this taper is a first temperature-dependent resistor 52 (NTC resistor), which is arranged as centrally as possible in the channel and is fastened here in such a way that no leaks occur as a result of the fastening. This resistor 52 is sharply cooled here by the high flow velocity. The channel 50 is subsequently expanded in the manner of a diffuser, in order that no high energy losses occur and as much air as possible flows through the measuring nozzle, and as little air as possible escapes into the external atmosphere via the gap in front of the mouth 49. A second temperature-dependent resistor 53 (NTC resistor) is then provided in a boundary location, protected as far as possible from the flow, in the flow channel 50 which is expanded in the manner of a diffuser. There is only a weak flow around the resistor, and it is cooled only slightly. If these two resistors 52, 53 are connected into a half bridge, and the half bridge is completed by two further resistors to form a full bridge, its diagonal voltage can then be used as a measured signal for the degree of permeability of the engraving of the area marks 4. This device 27" reacts in an extremely sensitive manner, even to very small flow velocities. Of course, it is also possible in each case to arrange two temperature-dependent resistors in the tapered and expanded flow channel position and to connect these in the form of a full bridge, which achieves an increase in the measured signal.

It would of course also be possible to detect the quantity of air permitted through the area marks 4 by means of a measuring diaphragm arrangement, known per se, or via a likewise known differential pressure measuring capsule. In the latter case, the static differential pressure is measured between the points of highest and lowest flow velocity in the measuring nozzle shown in FIG. 6.

The invention being thus described, it will be obvious that the same may be varied in many ways. The reference marks may be formed in a number of ways in addition to those set forth in the detailed description and the summary of the invention, on various types of stencil. Such variations are not to be regarded as a departure from the spirit and scope of the invention, and all such modifications as would be obvious to one skilled in the art are intended to be included within the scope of the following claims.

I claim:

1. A process for producing a half-tone stencil comprising:

providing a basic stencil element having a predetermined stencil pattern area for receiving a stencil pattern hole structure thereon to form a stencil pattern; and forming a plurality of reference hole structures having different degrees of permeability outside the pattern area on the basic stencil element.

2. The process according to claim 1, further comprising:

measuring a degree of permeability of each reference hole structure;

comparing a measured degree of permeability of each reference hole structure with a respective desired degree of permeability and outputting a respective deviation between the measured degree of permeability and the respective desired degree of permeability for each reference hole structure; and decreasing the deviation by further forming the reference hole structures as a function of the respective deviation.

3. The process according to claim 2, further comprising repeating said measuring, comparing and decreasing for a reference hole structure until the respective deviation is less than a predetermined deviation.

4. The process according to claim 2, further comprising engraving the stencil pattern hole structure lying in the stencil pattern area as a function of the deviations.

5. The process according to claim 2, further comprising removing reference hole structures after their degree of permeability has been compared with the desired degree of permeability.

6. The process according to claim 5, wherein the further forming includes, after said removing of reference hole structures, forming new reference hole structures.

7. The process according to claim 2, wherein the measuring includes automatically measuring the degree of permeability of a respective reference hole structure.

8. The process according to claim 2, wherein the further forming of reference hole structures includes varying a pulse duty factor of a laser beam in accordance with the deviation.

9. The process according to claim 2, wherein the further forming of a reference hole structure includes varying an on/off switching cycle of a nozzle spraying out covering lacquer in accordance with the deviation.

10. The process according to claim 1, wherein the basic stencil element is a screen and the forming includes applying a covering layer which leaves screen openings free in predetermined areas.

11. The process according to claim 10, further comprising measuring a degree of permeability of the reference hole structure by passing a beam of light through the screen openings.

12. The process according to claim 10, further comprising measuring a degree of permeability of the reference hole structure by passing a stream of gas through the screen openings.

13. The process according to claim 1, wherein the basic stencil element has a closed surface, and the forming includes applying a covering layer which leaves the closed surface free in predetermined areas.

14. The process according to claim 13, further comprising measuring a degree of permeability of the reference hole structure by reflecting a beam of light at the free surface.

15. The process according to claim 1, wherein the basic stencil element is a hollow cylinder.

16. The process according to claim 1, wherein the forming includes forming reference hole structures of uniform size and shape.

* * * * *